US008408431B2

(12) United States Patent
Fontela et al.

(10) Patent No.: US 8,408,431 B2
(45) Date of Patent: Apr. 2, 2013

(54) VALVE

(75) Inventors: Jacques Fontela, Vitot (FR); Frederic Pirou, Crasville (FR); David Goujon, Saint Leger du Bourg Denis (FR)

(73) Assignee: Aptar France SAS, Le Neubourg (FR)

( * ) Notice: Subject to any disclaimer, the term of this patent is extended or adjusted under 35 U.S.C. 154(b) by 286 days.

(21) Appl. No.: 12/742,863

(22) PCT Filed: Nov. 24, 2008

(86) PCT No.: PCT/FR2008/052110

§ 371 (c)(1),
(2), (4) Date: Sep. 8, 2010

(87) PCT Pub. No.: WO2009/071823

PCT Pub. Date: Jun. 11, 2009

(65) Prior Publication Data

US 2010/0327026 A1 Dec. 30, 2010

(30) Foreign Application Priority Data

Nov. 26, 2007 (FR) ..... 07 59306

(51) Int. Cl.
*B65D 83/00* (2006.01)

(52) U.S. Cl. ..... 222/402.2

(58) Field of Classification Search ..... 222/402.1, 222/402.2, 402.19; 137/353, 354, 540; 251/322, 251/323

See application file for complete search history.

(56) References Cited

U.S. PATENT DOCUMENTS

| | | | | |
|---|---|---|---|---|
| 1,342,486 | A * | 6/1920 | Wolfard | 239/453 |
| 2,868,460 | A * | 1/1959 | Hansen et al. | 236/92 C |
| 4,413,755 | A * | 11/1983 | Brunet | 222/402.2 |
| 4,744,495 | A * | 5/1988 | Warby | 222/402.16 |
| 5,477,992 | A * | 12/1995 | Jinks et al. | 222/402.2 |
| 6,539,969 | B1 * | 4/2003 | Sullivan | 137/15.18 |
| 7,195,139 | B2 * | 3/2007 | Jaworski et al. | 222/645 |
| 2002/0030068 | A1 * | 3/2002 | Burt | 222/402.1 |
| 2006/0243753 | A1 * | 11/2006 | Goujon et al. | 222/402.2 |
| 2006/0249543 | A1 * | 11/2006 | Pardonge et al. | 222/402.1 |
| 2008/0185402 | A1 * | 8/2008 | Fontela et al. | 222/402.2 |

FOREIGN PATENT DOCUMENTS

| | | | |
|---|---|---|---|
| FR | 1 247 934 | A | 12/1960 |
| FR | 2 888 822 | A1 | 1/2007 |
| GB | 2004526 | A * | 4/1979 |
| GB | 2178398 | A * | 2/1987 |
| GB | 2206099 | A * | 12/1988 |

OTHER PUBLICATIONS

International Preliminary Report issued on Jun. 29, 2010 for counterpart application PCT/FR2008/052110.

* cited by examiner

*Primary Examiner* — Kevin P Shaver
*Assistant Examiner* — Vishal Pancholi
(74) *Attorney, Agent, or Firm* — Sughrue Mion, PLLC

(57) ABSTRACT

A fluid dispenser valve having a valve body (10) containing a metering chamber (20), and a valve member (30) that is slidable in the valve body (10) between a rest position and a dispensing position so as to dispense the contents of the metering chamber (20) selectively. The valve member (30) is urged resiliently towards its rest position by a spring (8) that co-operates firstly with the valve body (10) and secondly with a radial collar (320) of the valve member (30), the radial collar (320) being of a shape that is polygonal, the vertices (325) of the polygon being substantially rounded.

8 Claims, 1 Drawing Sheet

VALVE

The present invention relates to a fluid dispenser valve.

More precisely, the present invention relates to a metering valve in which a precise dose of fluid is dispensed each time the valve is actuated. Such valves are well known in the prior art, and they are generally assembled on a reservoir containing fluid and a propellant gas that is used to expel the dose. Two types of metering valve are known in particular, namely firstly those that, after the metering chamber has been filled, close said chamber in leaktight manner until the next time the valve is actuated, and secondly those that become filled only just before actuation proper. In the first category, a problem may occur of a dose being incomplete and/or of a dose not being uniform while being expelled, in particular if the valve has been stored for a certain length of time, thereby causing the active substance no longer to be distributed in completely uniform manner in the metering chamber. To avoid this problem, valves of the second category enable the metering chamber to be filled at the time the user is going to actuate the valve. With this type of valve, after each actuation, the metering chamber may be filled once again, but if the valve is then stored in its upright position, the metering chamber may empty into the reservoir, since the metering chamber is not closed in leaktight manner.

Documents FR-1 247 934 and FR-2 888 822 describe prior-art valves.

An object of the present invention is to improve metering valves of the second category, i.e. metering valves in which the metering chamber is not closed in leaktight manner when the valve member is in the rest position.

A particular object of the present invention is to provide a fluid dispenser valve that is simple and inexpensive to manufacture and to assemble, and that is reliable in operation.

Another object of the present invention is to provide a fluid dispenser valve that makes it possible to fill the metering chamber in easy and reliable manner before each actuation, while guaranteeing good reliability of operation for said valve.

The present invention thus provides a fluid dispenser valve according to claim 1.

Advantageous embodiments are described in the dependent claims.

The present invention also provides a fluid dispenser device including a valve as described above.

Advantageously, said device is an inhaler of the Metered Dose Inhaler (MDI) type.

Figure 1:
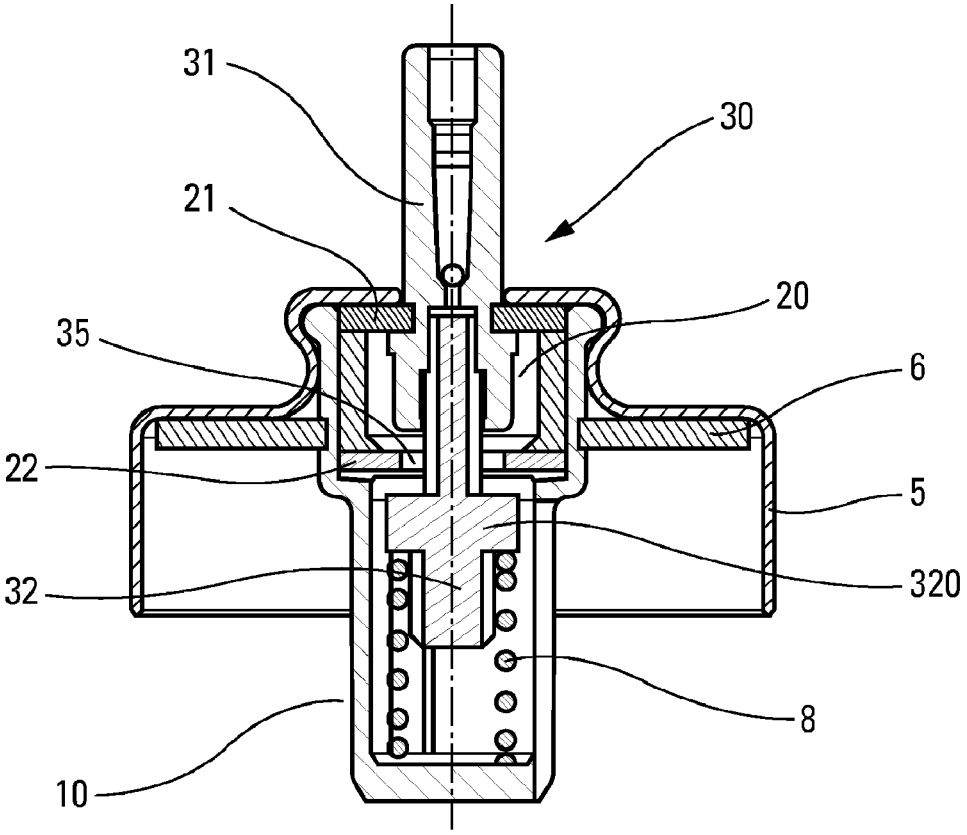
Figure 2:
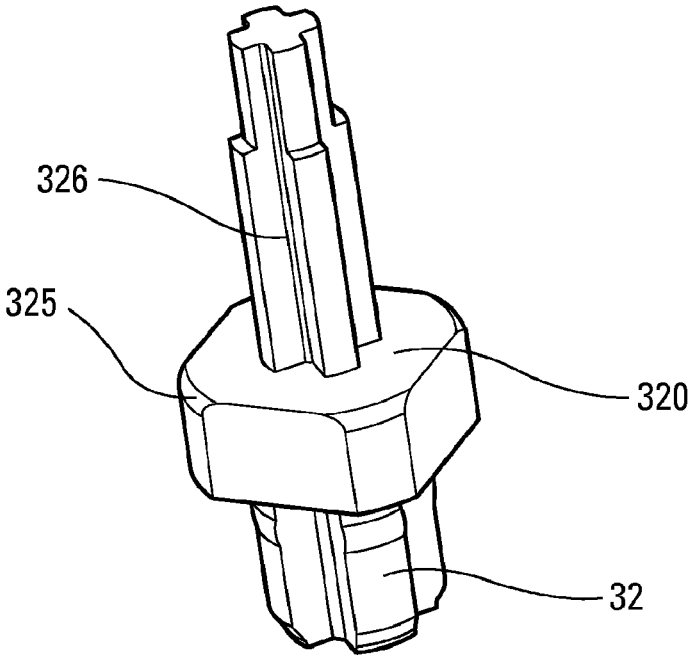

These and other characteristics and advantages of the present invention appear more clearly from the following detailed description of an embodiment thereof, given by way of non-limiting example, and with reference to the accompanying drawing, in which:

FIG. 1 is a diagrammatic section view of a dispenser valve constituting an embodiment of the present invention, shown in its rest position; and FIG. 2 is a detailed view in perspective of the bottom portion of the valve member of the FIG. 1 valve.

The valve shown in FIG. 1 includes a cylindrical valve body 10 inside which a valve member 30 slides between a rest position, as shown in the figure, and a dispensing position in which the valve member 30 is driven into the valve body 10. The valve is generally for assembling on a reservoir (not shown), preferably by means of a fastener element 5 that may be a crimpable, screw-fastenable, or snap-fastenable capsule, and a neck gasket 6 is advantageously interposed between the fastener element and the reservoir. Optionally, an inner ring (not shown) may be assembled around the valve body, in particular so as to reduce the dead volume in the upsidedown position and/or so as to limit contact of the fluid with the neck gasket. The valve member 30 is urged towards its rest position by a spring 8 that is disposed in the valve body 10 and that co-operates firstly with the valve body 10 and secondly with a radial support collar 320 of the valve member 30. A metering chamber 20 is defined inside the valve body 10, said valve member 30 sliding inside said metering chamber so as to enable the contents thereof to be dispensed when the valve is actuated. In conventional manner, the metering chamber is preferably defined between two annular gaskets, namely a valve-member gasket 21, and a chamber gasket 22. FIG. 1 shows the valve in the rest position of the valve member and in the upright position, i.e. the position in which the metering chamber 20 is disposed above the reservoir (not shown).

As shown in FIG. 1, when the valve member 30 is in its rest position, the metering chamber 20 is preferably connected to the reservoir in permanent manner, since the metering chamber 20 is not closed in leaktight manner when the valve member 30 is in the rest position. When the valve is stored in its upright position, the metering chamber therefore empties, and thus when the user wishes to use the valve it is necessary to turn it upsidedown, i.e. into the position in which the metering chamber 20 is disposed below the reservoir so that said metering chamber is filled by gravity.

In the invention, the radial collar 320 is of a shape that is polygonal, the vertices 325 of the polygon being substantially rounded. Preferably, said rounded vertices 325 are disposed at a short distance from the valve body, so as to provide the valve member with stable guidance, and so as to avoid any risk of the valve member being axially offset while it is being actuated. This makes the operation of the valve more reliable. More precisely, as a result of the small spacing between the outer periphery of the collar 320 and the valve body 10, if the outside of the collar of the valve member were circular in shape, then a flow passing exclusively outside the collar would run the risk of being hindered or at least slowed down, and that could pose metering problems when the user actuates the valve relatively quickly after turning it upsidedown. As a result of widening the fluid-flow passage 35 by making a collar polygonal in shape, it is possible to guarantee a more rapid flow, and thus more reliable filling of the metering chamber 20. As shown more precisely in FIG. 2, the radial collar 320 may be square, but other polygonal shapes may also be envisaged (triangular, rectangular, lozenge-shaped, pentagonal, hexagonal, etc.).

In the embodiment in FIGS. 1 and 2, the valve member 30 made of two portions, namely a top portion 31 (also known as a valve-member top) and a bottom portion 32 (also known as a valve-member bottom) relative to the valve in the upright position of FIG. 1. In this embodiment, the bottom portion 32 is assembled inside the top portion 31, and the collar 320 forms an integral part of the bottom portion 32, as shown clearly in FIG. 2.

In a variant, the collar 320 could form part of a tubular part that would be assembled around the valve member 30, preferably as a tight fit. In this embodiment, the valve member 30 would be made substantially as a single piece, and it is the tubular part that would define both the collar 320 that enables the valve member to be guided in effective manner while it is being actuated, and the passage for the flow of fluid as described with reference to the first embodiment shown in FIGS. 1 and 2. Such an embodiment would provide better rigidity as a result of there not being any need to assemble together a bottom portion and a top portion of the valve member. In yet another variant, the valve member 30 and the collar 320 could be formed as a single piece.

In a variant, the collar 320, which is solid in the embodiment in FIG. 2, could also include one or more through passages or slots (not shown) for the fluid. Passages or slots 326 may also be provided on the valve-member portion disposed between the collar 320 and the gasket 22, so as to encourage filling of the metering chamber in the upsidedown position.

The present invention applies in particular to inhalers comprising a metering valve assembled on an aerosol reservoir, that assembly being placed in a body provided with a mouthpiece. This type of inhaler is generally known as a Metered Dose Inhaler (MDI).

Although the present invention is described above with reference to an embodiment thereof, naturally it is not limited by the embodiment shown. On the contrary, any useful modification could be applied thereto by a person skilled in the art, without going beyond the ambit of the present invention, as defined by the accompanying claims.

The invention claimed is:

1. A fluid dispenser valve comprising a valve body (10) containing a metering chamber (20), and a valve member (30) that is slidable in said valve body (10) between a rest position and a dispensing position so as to dispense the contents of said metering chamber (20) selectively, said valve member (30) being urged resiliently towards its rest position by a spring (8) that co-operates firstly with the valve body (10) and secondly with a radial collar (320) of the valve member (30), wherein said radial collar (320) is of a shape that is polygonal, the vertices (325) of said polygon being substantially rounded; and wherein, in the rest position of the valve member, said metering chamber is connected to a fluid reservoir containing the fluid to be dispensed, via a fluid-flow passage, so as to enable the metering chamber to be filled by gravity when, with the valve member in the rest position, the valve is upside down with the metering chamber disposed below the reservoir, and so as to enable said metering chamber to be emptied by gravity when, with the valve member in the rest position, the valve is upright with the metering chamber disposed above the reservoir.

2. A valve according to claim 1, wherein said radial collar is of square or of rectangular shape.

3. A valve according to claim 1, wherein, at said rounded vertices, said radial collar is disposed at a short distance from said valve body, so as to provide the valve member with stable guidance in said valve body.

4. A valve according to claim 1, wherein said radial collar (320) is formed in a bottom valve-member portion (32) that is assembled in a top valve-member portion (31).

5. A valve according to claim 1, wherein said collar (320) is formed on a tubular part that is assembled around said valve member (30), in particular as a tight fit.

6. A valve according to claim 1, wherein said valve member (30) and said collar (320) are formed as a single piece.

7. A fluid dispenser device, comprising the fluid reservoir containing the fluid to be dispensed and a valve according to claim 1 operatively connected to the reservoir for dispensing the fluid.

8. A device according to claim 7, wherein said device is an inhaler of the MDI type.

* * * * *